US006386215B1

(12) United States Patent
Chang

(10) Patent No.: US 6,386,215 B1
(45) Date of Patent: May 14, 2002

(54) UMBRELLA FRAME

(76) Inventor: Wei-Chen Chang, 30, Ko Wha Street, Cha Yi (TW)

( * ) Notice: Subject to any disclaimer, the term of this patent is extended or adjusted under 35 U.S.C. 154(b) by 0 days.

(21) Appl. No.: 09/753,384

(22) Filed: Jan. 3, 2001

(51) Int. Cl.[7] ..... A25B 25/06

(52) U.S. Cl. ..... 135/20.3; 135/28; 135/38

(58) Field of Search ..... 135/28, 38, 20.3, 135/41

(56) References Cited

U.S. PATENT DOCUMENTS 3,252,468 A * 5/1966 Militano
5,193,566 A * 3/1993 Chen

FOREIGN PATENT DOCUMENTS

FR 568180 * 12/1923 ..... 135/28

* cited by examiner

*Primary Examiner*—Robert Canfield
(74) *Attorney, Agent, or Firm*—Alan Kamrath; Rider, Bennett, Egan & Arundel, LLP

(57) ABSTRACT

An umbrella frame has a hollow shaft, an upper runner disposed on the hollow shaft, a lower runner receiving the hollow shaft, the upper runner having a first upper casing and a first lower casing, the lower runner having a second upper casing and a second lower casing, a key-shaped hole formed on the second upper casing, a thread inserted through the key-shaped hole, the thread having a blocking end, a plug inserted in the key-shaped hole, a winding device inserted through the hollow shaft, and the thread connected to the winding device. A plurality of ribs are connected to the first upper casing. A plurality of stretchers are connected to the lower runner.

2 Claims, 7 Drawing Sheets

UMBRELLA FRAME

BACKGROUND OF THE INVENTION

The present invention relates to an umbrella frame. More particularly, the present invention relates to an umbrella frame which has an upper runner and a lower runner to be assembled easily.

A conventional umbrella frame has an upper runner and a lower runner as shown in U.S. Pat. Nos. 4,567,907, 4,993,445, 5,601,103, 5,617,888, 5,020,557, 4,622,987, and 4,319,660. When a stretcher is broken, all the stretchers should be detached in order to replace the broken stretcher.

SUMMARY OF THE INVENTION

An object of the present invention is to provide an umbrella frame which has an upper runner and a lower runner to be assembled easily.

Another object of the present invention is to provide an umbrella frame which has an upper runner and a lower runner to be detached easily.

Accordingly, an umbrella frame comprises a hollow shaft, an upper runner disposed on the hollow shaft, a lower runner receiving the hollow shaft, the upper runner having a first upper casing and a first lower casing, the lower runner having a second upper casing and a second lower casing, a key-shaped hole formed on the second upper casing, a thread inserted through the key-shaped hole, the thread having a blocking end, a plug inserted in the key-shaped hole, a winding device inserted through the hollow shaft, and the thread connected to the winding device. A plurality of ribs are connected to the first upper casing. Each of the ribs has a pivot end having a through aperture. A plurality of stretchers are connected to the lower runner and the ribs. The first upper casing has a plurality of spaced hollow seats, a plurality of threaded holes, and a plurality of spaced blocking plates. Each of the spaced hollow seats has an opening and two lower notches. Each of the spaced hollow seats receives the respective rib. The first lower casing has a plurality of spaced upper bars and a plurality of spaced blocking posts. Each of the spaced upper bars has a threaded aperture matching the respective threaded hole of the first upper casing. A plurality of pivot pins are disposed in the first upper casing. Each of the pivot pins passes through the lower notches of the respective spaced hollow seat and the through aperture of the pivot end of the respective rib. Each of the pivot pins is blocked by two of the spaced blocking plates. The first lower casing engages with the first upper casing. A bolt passes through one of the threaded holes of the first upper casing and the threaded aperture of the respective spaced upper bar to fasten the first upper casing and the first lower casing together.

DETAILED DESCRIPTION OF THE INVENTION

Figure 1:
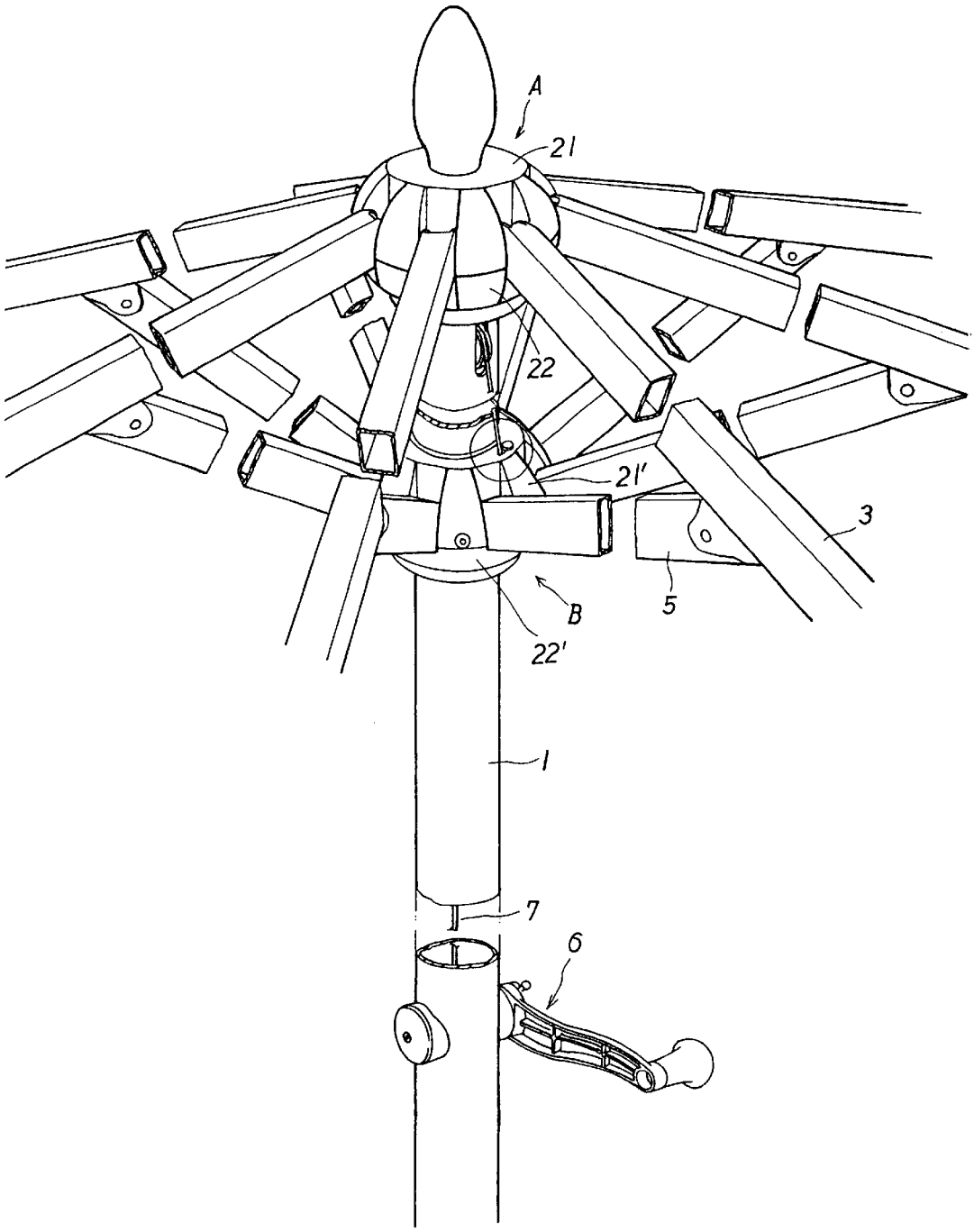
FIG. 1 is a perspective assembly view of an umbrella frame of a preferred embodiment in accordance with the present invention.
Figure 2:
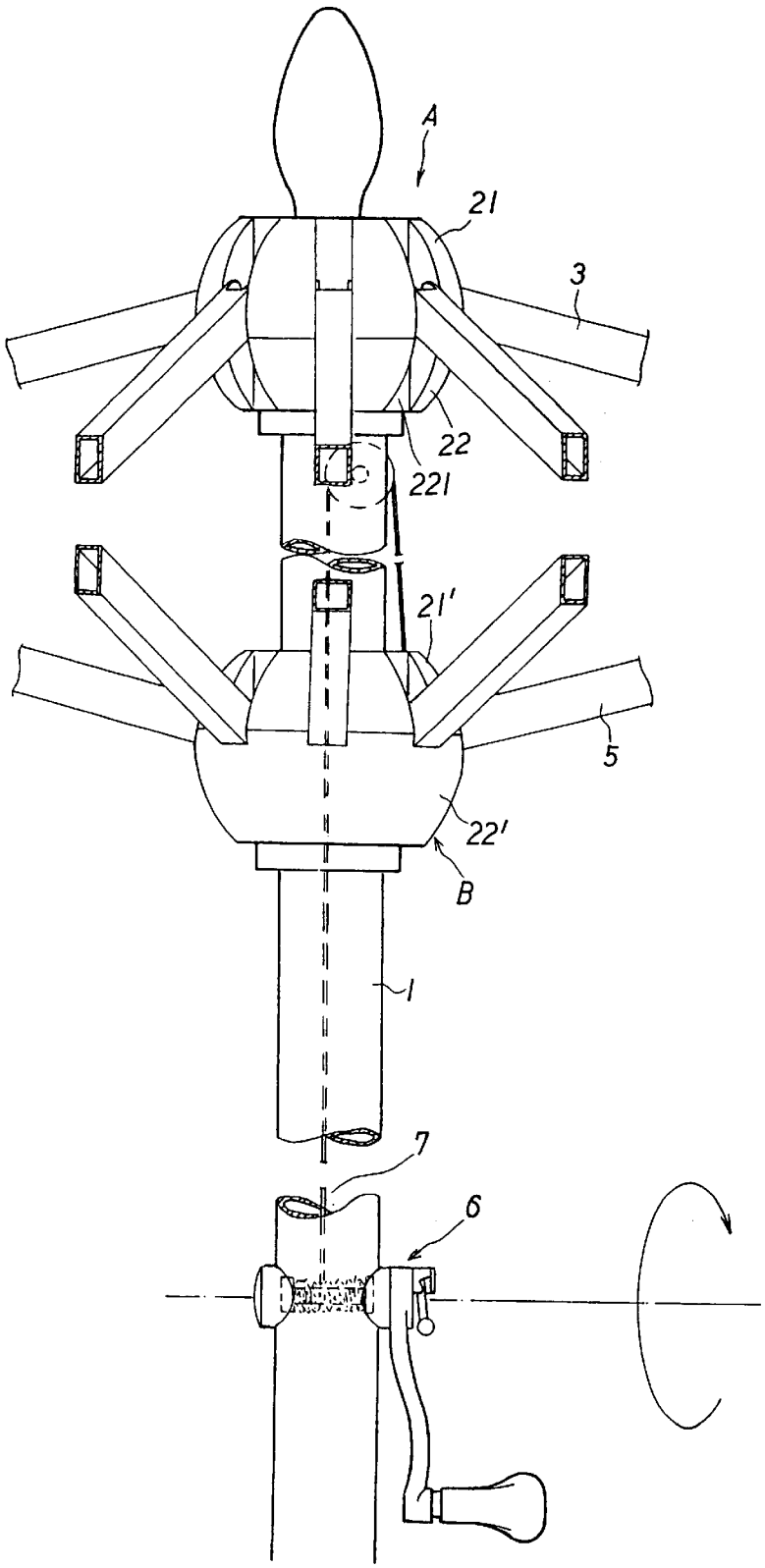
FIG. 2 is a partially perspective view of FIG. 1.
Figure 3:
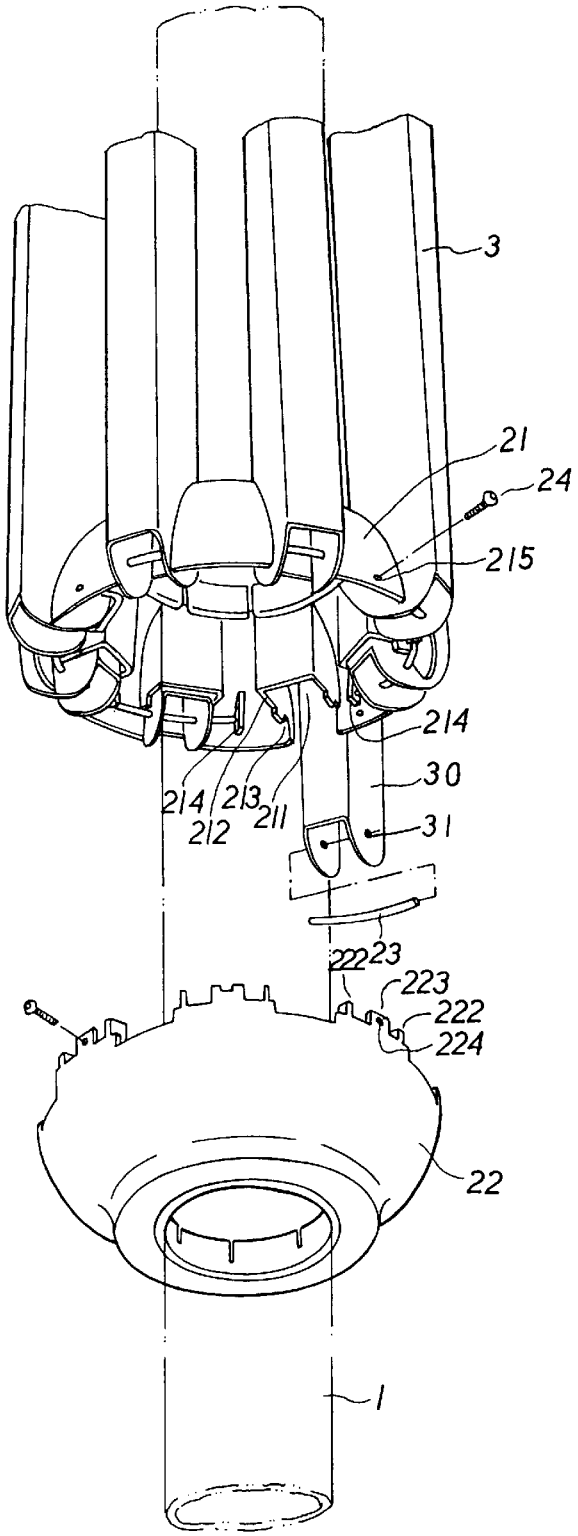
FIG. 3 is a perspective exploded view of an upper runner of a preferred embodiment in accordance with the a-present invention.
Figure 4:
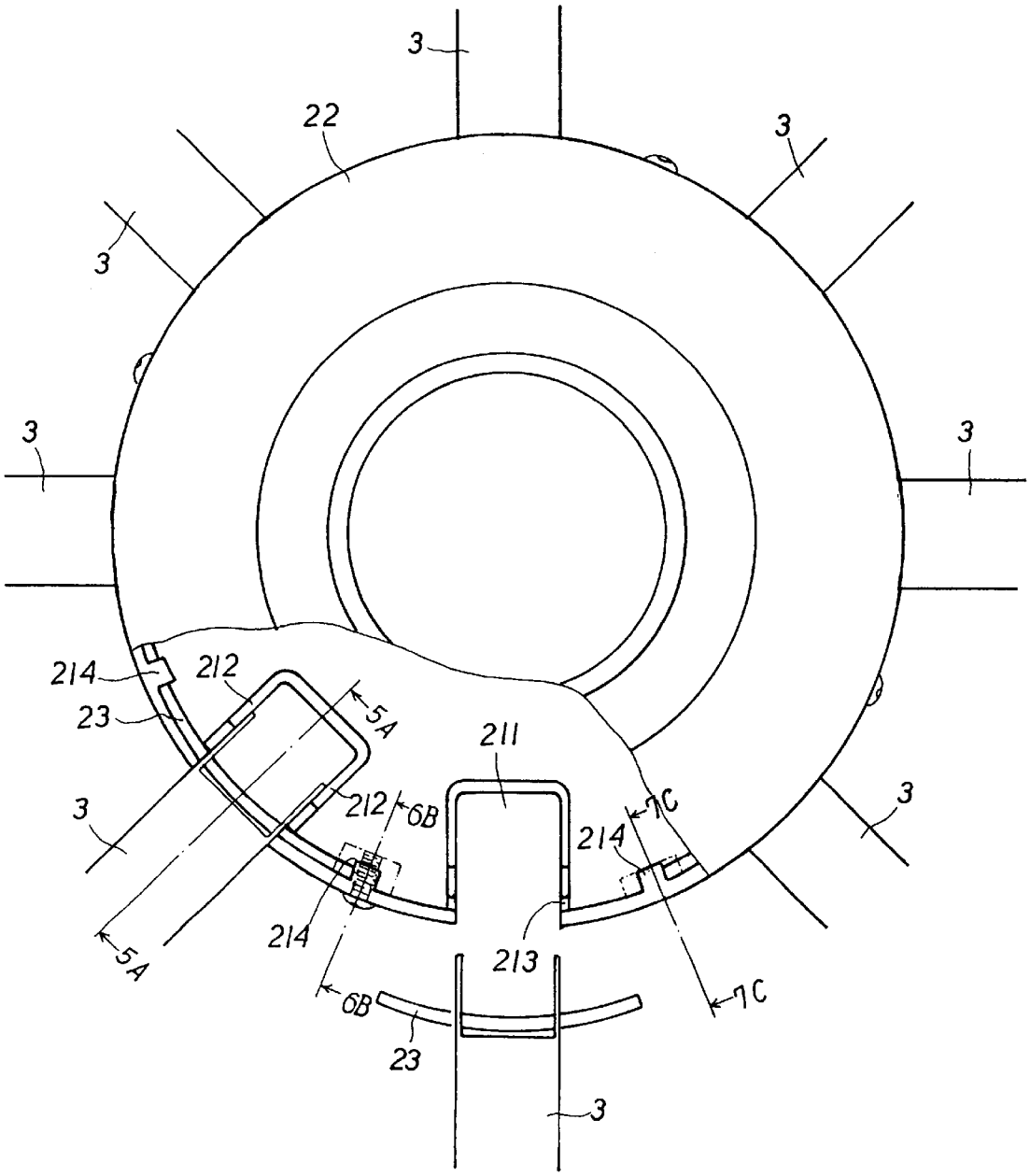
FIG. 4 is a bottom plan view of an upper runner of a preferred embodiment in accordance with the present invention.
Figure 5:
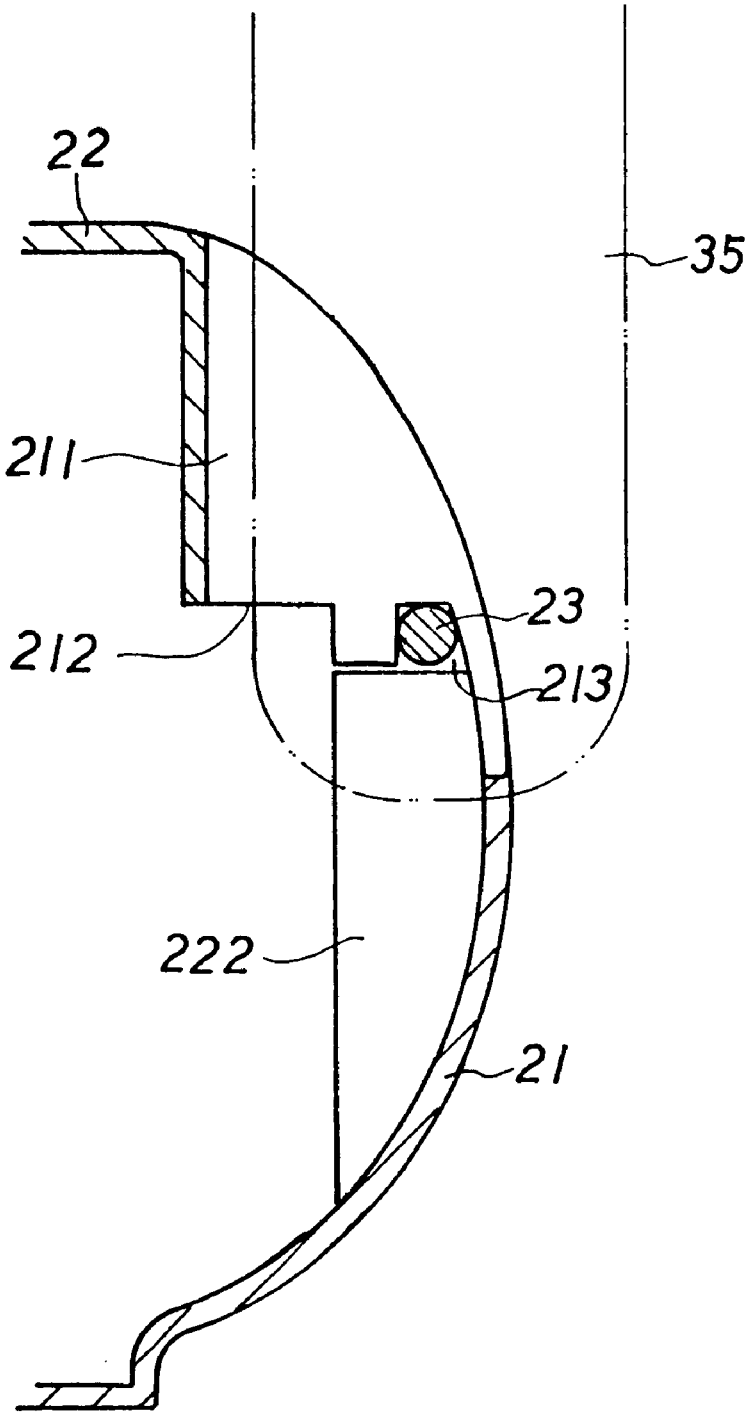
FIG. 5 is a sectional view taken along line 5A—5A in FIG. 4.
Figure 7:
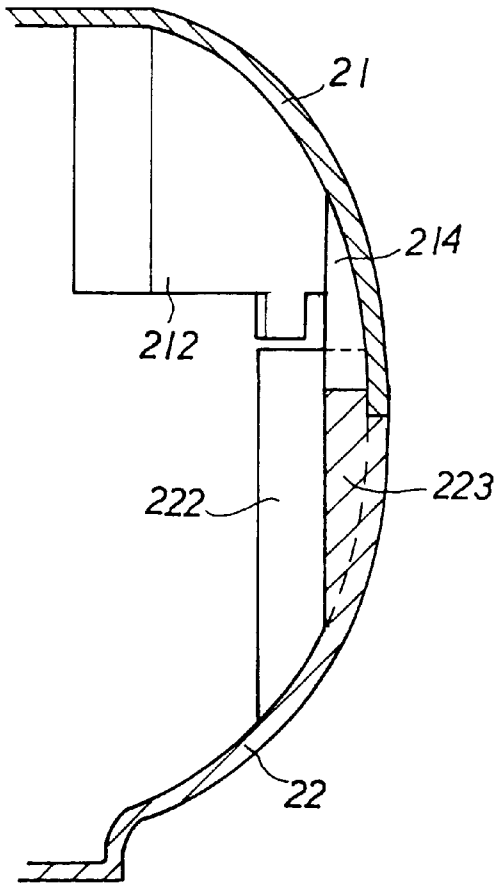
FIG. 7 is a sectional view taken along line 7C—7C in FIG. 4.
Figure 6:
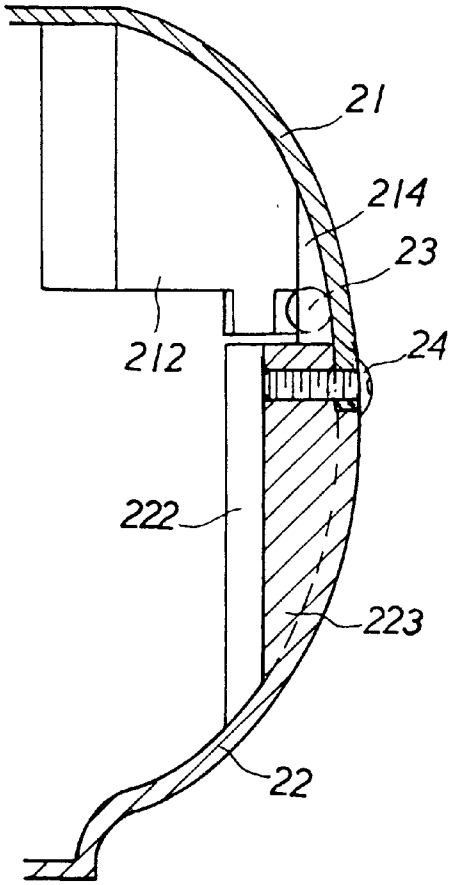
FIG. 6 is a sectional view taken along line 6B—6B in FIG. 4.
Figure 8:
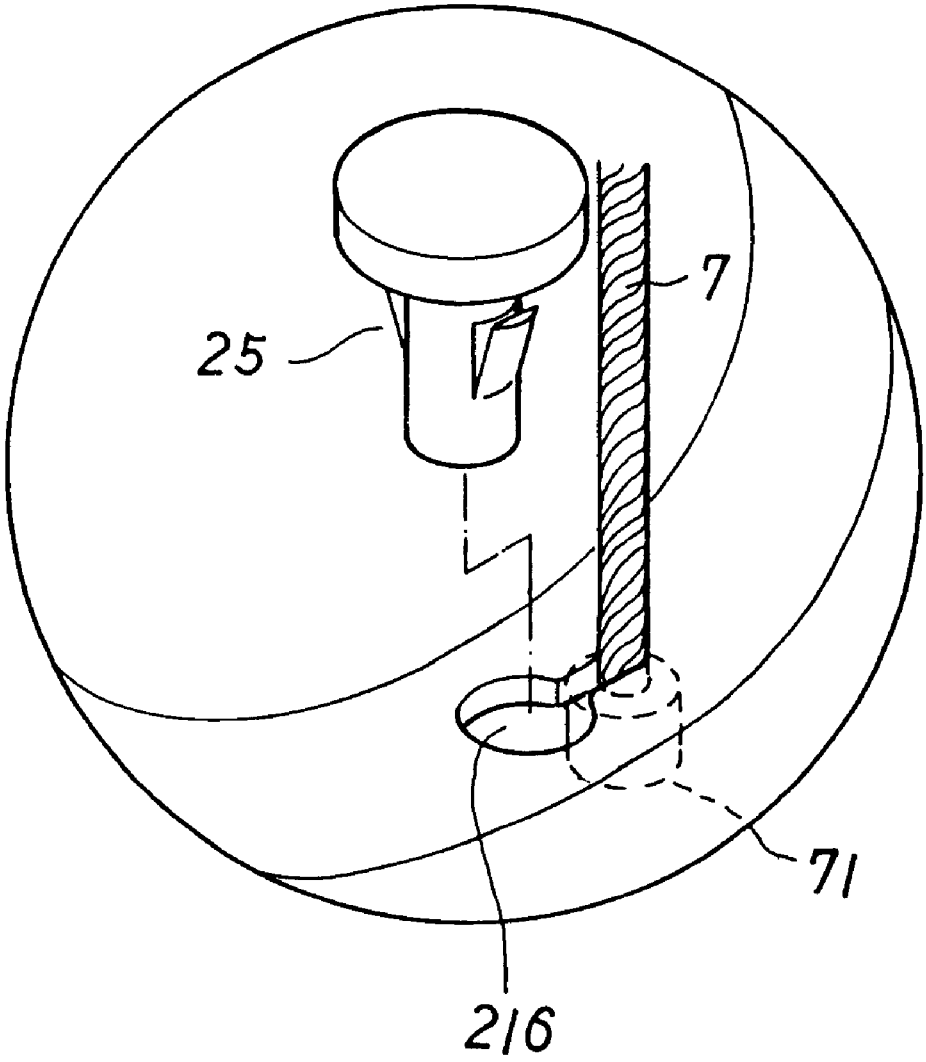
FIG. 8 is a schematic view illustrating a blocking end of a thread blocked by a key-shaped hole of a lower runner of a preferred embodiment in accordance with the present invention.

Referring to FIGS. 1 to 8 first, an umbrella frame comprises a hollow shaft 1, an upper runner A disposed on the hollow shaft 1, a lower runner B receiving the hollow shaft 1, the upper runner A having a first upper casing 21 and a first lower casing 22 engaging with the first upper casing 21, the lower runner B having a second upper casing 21' and a second lower casing 22' engaging with the second upper casing 21', a key-shaped hole 216 formed on the second upper casing 21', a thread 7 inserted through the key-shaped hole 216, the thread 7 having a blocking end 71, a plug 25 inserted in the key-shaped hole 216, a winding device 6 inserted through the hollow shaft 1, and the thread 7 connected to the. winding device 6.

A plurality of ribs 3 are connected to the first upper casing 21.

Each of the ribs 3 has a pivot end 30 having a through aperture 31.

A plurality of stretchers 5 are connected to the lower runner B and the ribs 3.

The first upper casing 21 has a plurality of spaced hollow seats 212, a plurality of threaded holes 215, and a plurality of spaced blocking plates 214.

Each of the spaced hollow seats 212 has an opening 211 and two lower notches 213.

Each of the spaced hollow seats 212 receives the respective rib 3.

The first lower casing 22 has a plurality of spaced upper bars 223 and a plurality of spaced blocking posts 222.

Each of the spaced upper bars 223 has a threaded aperture 224 matching the respective threaded hole 215 of the first upper casing 21.

A plurality of pivot pins 23 are disposed in the first upper casing 21.

Each of the pivot pins 23 passes through the lower notches 213 of the respective spaced hollow seat 212 and the through aperture 31 of the pivot end 30 of the respective rib 3.

Each of the pivot pins 23 is blocked by two of the spaced blocking plates 214.

The first lower casing 22 engages with the first upper casing 21.

A bolt 24 passes through one of the threaded holes 215 of the first upper casing 21 and the threaded aperture 224 of the respective spaced upper bar 223 to fasten the first upper casing 21 and the first lower casing 22 together.

The structure of the lower runner B is the same as the structure of the upper runner A.

The present invention is not limited to the above embodiment but various modification thereof may be made. Furthermore, various changes in form and detail may be made without departing from the scope of the present invention.

I claim:

1. An umbrella frame comprises:

a hollow shaft, an upper runner disposed on the hollow shaft, a lower runner receiving the hollow shaft, the upper runner having a first upper casing and a first lower casing, the lower runner having a second upper casing and a second lower casing, a key-shaped hole formed on the second upper casing, a thread inserted through the key-shaped hole, the thread having a blocking end, a plug inserted in the key-shaped hole, a winding device inserted through the hollow shaft, and the thread connected to the winding device, a plurality of ribs connected to the first upper casing, each of the ribs having a pivot end having a through aperture, a plurality of stretchers connected to the lower runner and the ribs, the first upper casing having a plurality of spaced hollow seats, a plurality of threaded holes, and a plurality of spaced blocking plates, each of the spaced hollow seats having an opening and two lower notches, each of the spaced hollow seats receiving the respective rib, the first lower casing having a plurality of spaced upper bars and a plurality of spaced blocking posts, each of the spaced upper bars having a threaded aperture matching the respective threaded hole of the first upper casing, a plurality of pivot pins disposed in the first upper casing, each of the pivot pins passing through the lower notches of the respective spaced hollow seat and the through aperture of the pivot end of the respective rib, each of the pivot pins blocked by two of the spaced blocking plates, the first lower casing engaging with the first upper casing, and a bolt passing through one of the threaded holes of the first upper casing and the threaded aperture of the respective spaced upper bar to fasten the first upper casing and the first lower casing together.

2. The umbrella frame as claimed in claim 1, wherein a structure of the lower runner is the same as the structure of the upper runner.

* * * * *